US008298653B2

(12) United States Patent
Kuboyama et al.

(10) Patent No.: US 8,298,653 B2
(45) Date of Patent: Oct. 30, 2012

(54) RECORDING MEDIUM

(75) Inventors: Hiroki Kuboyama, Mishima (JP); Yasuhiro Kadota, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 523 days.

(21) Appl. No.: 12/559,709

(22) Filed: Sep. 15, 2009

(65) Prior Publication Data

US 2010/0068426 A1 Mar. 18, 2010

(30) Foreign Application Priority Data

Sep. 17, 2008 (JP) ..... 2008-237537
Sep. 17, 2008 (JP) ..... 2008-237542

(51) Int. Cl.
*B41M 5/00* (2006.01)
*B44C 1/17* (2006.01)
*G03G 7/00* (2006.01)

(52) U.S. Cl. ..... 428/195.1; 428/32.6

(58) Field of Classification Search ..... 428/195.1, 428/32.6

See application file for complete search history.

(56) References Cited

U.S. PATENT DOCUMENTS

| | | | | |
|---|---|---|---|---|
| 4,904,636 | A | 2/1990 | Hayashi et al. | |
| 5,284,705 | A | 2/1994 | Cahill | |
| 5,350,448 | A | 9/1994 | Dietz et al. | |
| 6,464,351 | B1 * | 10/2002 | Landry-Coltrain et al. | 347/105 |
| 6,713,164 | B1 | 3/2004 | Hareyama et al. | |
| 7,419,935 | B2 | 9/2008 | Kadota et al. | |
| 7,425,522 | B2 | 9/2008 | Kadota et al. | |
| 2003/0001937 | A1 * | 1/2003 | Landry-Coltrain et al. | 347/100 |
| 2003/0003276 | A1 | 1/2003 | Mizuhara et al. | |
| 2003/0138604 | A1 * | 7/2003 | Landry-Coltrain et al. | 428/195 |
| 2006/0234147 | A1 * | 10/2006 | Wu et al. | 430/63 |
| 2008/0063817 | A1 | 3/2008 | Tanaka et al. | |
| 2009/0264228 | A1 | 10/2009 | Tiura | |

FOREIGN PATENT DOCUMENTS

| | | | |
|---|---|---|---|
| CN | 1077729 | A | 10/1993 |
| CN | 101253052 | A | 8/2008 |
| EP | 0283032 | A2 | 9/1988 |
| EP | 1008618 | A1 | 6/2000 |
| EP | 1238818 | A1 | 9/2002 |
| EP | 1655144 | A1 | 5/2006 |
| JP | 63-230388 | | 9/1988 |
| JP | 2000-250250 | | 9/2000 |
| JP | 2001-11125 | | 1/2001 |
| JP | 2002-293020 | | 10/2002 |
| JP | 2002-356057 | | 12/2002 |
| JP | 2003-182206 | | 7/2003 |
| JP | 2004-196988 | | 7/2004 |
| JP | 2005-511343 | | 4/2005 |
| JP | 2005-231095 | | 9/2005 |
| JP | 2007-76251 | | 3/2007 |
| JP | 2007-223257 | | 9/2007 |
| WO | WO94/05506 | | 3/1994 |
| WO | WO03/037641 | A3 | 5/2003 |

OTHER PUBLICATIONS

Dec. 27, 2010 Chinese official action in connection with a counterpart Chinese patent application.
Dec. 30, 2009 European official action in connection with counterpart European patent application No. 09 17 0399.

* cited by examiner

*Primary Examiner* — Betelhem Shewareged
(74) *Attorney, Agent, or Firm* — Cooper & Dunham LLP

(57) ABSTRACT

A recording medium contains a support, and an antistatic agent-containing layer, and the antistatic agent-containing layer contains a binder resin and tin oxide-coated titanium oxide particles.

16 Claims, No Drawings

RECORDING MEDIUM

BACKGROUND OF THE INVENTION

1. Field of the Invention

The present invention relates to a recording medium.

2. Description of the Related Art

In recent years, researches and developments have been made to various recording materials, such as inkjet recording mediums and thermosensitive recording mediums, in the field of information recording, and the results thereform have also be made into practice so as to meet the diversity of information and needs in the art.

An inkjet recording system is a system where images or characters are recorded by jetting small droplets of an ink according to various operating principles, and depositing the ink on a recording medium such as a piece of paper.

Printers applying the inkjet recording system have characteristics such that a recording can be performed at high speed and with low noise, images can be easily produced in various colors, there is a large flexibility in recording patterns, and no special developing and/or fixing processing is necessary. For these reasons, use of such printers has been rapidly spread as recording devices of various images in various applications including information devices.

Moreover, the inkjet recording system has recently been significantly improved as the technology that enables to attain images of high accuracy and high quality.

Furthermore, the inkjet recording system has been rapidly developed to occupy a large part of the market of the image forming technology, resulted from the rapid spread of personal computers or internet, or the social needs such as the necessity of visual presentations.

However, along with the improvements of performances, e.g. a recording speed, of the recent inkjet printers, some of the inkjet printers generates a large amount of static electricity.

Especially, the static electricity generated near a surface of an ink-receiving layer is problematic, and this gives adverse influence to handlings such as conveyance, also scattering an ink at the time of recording to thereby cause background depositions.

Since particles contained in an ink have recently been getting smaller and smaller to achieve high accuracy and high image quality, such particles are easily influenced by static electricity. Therefore, occurrences of background depositions become a serious problem.

Moreover, static electricity also causes, other than background depositions, inferior conveyance such as conveyance of sheets with being stacked, at the time when recording mediums in the shape of sheets are conveyed, causing paper jam in the conveyance system. Therefore, an improvement is desired to solve such the problems.

To solve such problems due to static electricity, an antistatic agent is added to an inkjet recording medium.

For example, Japanese Patent Application Laid-Open (JP-A) No. 2004-196988 discloses that an inkjet recording medium the size or shape of which can be easily changed by using a conductive conjugated polymer in the ink recording medium.

Moreover, JP-A Nos. 2001-11125 and 2005-511343 disclose that an inkjet recording medium of excellent antistatic property can be provided by using an ionic antistatic agent as an antistatic agent.

However, the antistatic agent using such ionic conductivity exhibits its antistatic function due to absorbing absorption thereof, and thus has poor water resistance. Therefore, in the case where a recording medium is immersed in water after inkjet recording, the recorded image is smeared, or is in the wet condition so that the image bleeding is caused with rubbing, to thereby lower the image density.

Moreover, the antistatic effect thereof tends to depend on the humidity, and such antistatic agent has weak antistatic function under the low temperature-low humidity environment.

Furthermore, JP-A No. 2005-231095 discloses an inkjet recording medium including an ink-receiving layer, in which the ink-receiving layer is formed of a high molecular binder material and is doped with metal antimonate such as zinc antimonate, and JP-A No. 2003-182206 discloses an inkjet recording medium having an ink-receiving layer containing a conductive polymer and metal antimonate such as zinc antimonate.

The antimony compound has a high antistatic effect compared to other inorganic antistatic agents, and thus is a material which has been used for a long time. However, the antimony compound is Class 1 Designated Chemical Substance, meaning that the antimony compound is harmful and thus designated by the government as a substance a handling of which needs to be controlled and monitored. Therefore, use of such compound in a product that can be touched by people, such as an inkjet recording medium, is not preferable in view of hazard thereof.

Furthermore, JP-A No. 2002-356057 discloses an ink-receiving body having a back layer using conductive tin oxide sol particles as an antistatic agent. However, such the conductive tin oxide sol particles are extremely expensive, and thus it is a current situation that such expensive material cannot be used for a recording medium which is sold at low price, such as an inkjet recording medium. JP-A No. 2000-250250 discloses a recording paper which is formed by making paper from pulp slurry containing at least two white extender pigments selected from titanium dioxide, calcium carbonate, and white carbon, and size pressing using a surface sizing agent containing an antistatic agent and a high molecular binder material. This recording paper is excellent as it has an anti-offset effect and prevents bleeding.

Accordingly, an inkjet recording medium which has high ink absorption, excellent water resistance, excellent antistatic properties, excellent properties for preventing the powder from falling off and high safety has been strongly desired to be provided.

Thermosensitive recording mediums have advantages such as (1) images are easily recorded only by a heating process; and (2) a device for use has a simple mechanism and can be easily downsized and the recording medium is easy to handle and cheap.

Therefore, the techniques of the thermosensitive recording have been used in various fields, such as information processing (e.g. output such as electronic desk calculators, and computers), recorders for medical instrumentations, low and high speed facsimiles, automated ticket vendors (for thickets such as railway tickets, and admission tickets), thermosensitive copying, labeling of POS system, and tabs.

In the thermosensitive recording medium, a coloring substance-containing layer is generally disposed on a paper support, and the coloring substance induces a coloring reaction by heating. The thermosensitive recording medium used for thickets is mounted to a printer in the shape of a roll, and is cut by a cutter disposed at the printer outlet after the image formation by a thermal head, to thereby give out a thicket.

However, paper powder is generated from the support when cut at the printer outlet, and is accumulated inside the printer as a number of given thickets is increased.

According to this, the paper powder and also dusts scattered in the air are deposited onto a surface of a thermosensitive recording medium by static electricity generated by a friction with a platen roll or a thermal head during printing in the printer, the deposited paper powder or dusts are nipped between the thermosensitive recording medium and the thermal head during printing, so that an image failure such as a phenomenon that a blank portion is formed in the shape of lines within the image at or near the part where the paper powder or dusts are deposited (hereinafter this phenomenon is referred as white lines), tends to be occurred.

To solve these problems, there is proposed a thermosensitive recording medium in which an antistatic agent is added in a recording surface or the opposite surface (hereinafter, may be referred as a back layer).

For this antistatic agent, (1) inorganic salts such as sodium chloride, (2) anionic polymer electrolytes such as sodium polystyrene sulfonate, and (3) conductive oxides such as conductive zinc oxide and conductive tin oxide, or conductive metal compounds such as silver, copper, nickel are used.

For example, JP-A No. 2007-76251 discloses a thermosensitive recording medium including a back layer using a binder resin material containing an antistatic agent formed of polyalkylene glycol and lithium perchlorate, and JP-A No. 2007-223257 discloses a thermosensitive recording material including a back layer using a crosslinkable acrylic emulsion binder material containing a water-soluble organic polymer antistatic agent.

However, the inorganic salts such as sodium chloride and the anionic polymer electrolytes such as sodium polystyrene sulfonate has a low effect considering the amount thereof to be added, and change their antistatic performances depending on the humidity. Moreover, they have stickiness under the high humidity environment because of the properties of the electrolytes thereof, and are hard to be dissolved in water.

JP-A No. 63-230388 discloses a thermosensitive recording material including a back layer using a binder resin material containing an antistatic agent that is conductive oxide titanium powder, the conductive oxide titanium powder being prepared by processing tin oxide powder with antimony oxide. JP-A No. 63-230388 also discloses that this conductive titanium oxide antistatic agent is "produced by a method containing adding a hydrochloric solution of antimony chloride and tin chloride into a suspension of titanium oxide powder, and hydrolyzing antimony chloride and tin chloride on the surface of each titanium oxide powder," but such description is far from the conventional method in which a hydrolyzing metal compound in the solution is hydrolyzed in the presence of alkali to form hydroxide, and hydroxide is sintered so as to modify the same into oxide. Other than that, the conductive metal compound exhibit an effect with a small amount thereof without depending on the temperature, but it has a drawback in terms of safety.

Moreover, the thermosensitive recording medium is used as a POS label for food or a thicket. Accordingly, the material may be wet with water in case of the label for fresh food, and may be wet with rain outside in case of the ticket, and thus it is important that the thermosensitive recording material has a water-proof property for the use of the thermosensitive recording medium.

Accordingly, it is a current situation that there has been strongly desired a thermosensitive recording medium, which has a low charging amount during printing, a low amount of the paper powder generated at the time of cutting the medium to thereby reduce conveyance failures or a deposition amount of the powder or dusts on the printing surface, is highly sensitive and excellent in storage stability, is excellent in terms of safety without influencing the environment, and has excellent water resistance.

BRIEF SUMMARY OF THE INVENTION

The present invention aims to solve the aforementioned various problems in the art, and to achieve the following objects.

A first object of the present invention is to provide a recording medium which has high ink absorption, is excellent in water resistance, antistatic properties, and properties for preventing the powder from falling off, and is highly safe.

A second object of the present invention is to provide a recording medium which has a small amount of the paper powder generated at the time of cutting, is excellent in safety without influencing the environment, exhibits a sufficient antistatic effect, is highly sensitive and excellent in storage stability, and water resistance.

As a result of dedicated researches and studies conducted by the present inventors to solve the above problems, it has been found that by having at least an antistatic agent-containing layer containing a binder resin and tin oxide-coated titanium oxide particles on a support, a recording medium, which has high ink absorption, is excellent in water resistance, antistatic properties, and properties for preventing the powder from falling off, and is highly safe, can be obtained; and also a recording medium, which has a small amount of the paper powder generated at the time of cutting, is excellent in safety without influencing the environment, exhibits a sufficient antistatic effect, is highly sensitive and excellent in storage stability, and water resistance, can be obtained.

The present invention is based upon the insights of the present inventors, and means for solving the aforementioned problems are as follow:

<1> A recording medium containing: a support; and an antistatic agent-containing layer containing a binder resin and tin oxide-coated titanium oxide particles.

<2> The recording medium according to <1>, wherein the binder resin is itaconic acid-modified polyvinyl alcohol.

<3> The recording medium according to any of <1> or <2>, wherein the tin oxide-coated titanium oxide particles have a volume average particle diameter of 0.2 μm to 5.0 μm.

<4> The recording medium according to any one of <1> to <3>, wherein the antistatic agent-containing layer comprises the tin oxide-coated titanium oxide particles in an amount of 0.1 $g/m^2$ to 1.0 $g/m^2$.

<5> The recording medium according to any one of <1> to <4>, wherein the support is any of a paper base, a nonwoven fabric base, a synthetic paper base, or a resin film base.

<6> The recording medium according to any one of <1> to <5>, wherein the antistatic agent-containing layer contains the tin oxide-coated titanium oxide particles in an amount of 5% to 50% in a weight ratio.

<7> The recording medium according to any one of <1> to <6>, wherein the antistatic agent-containing layer further contains a high oil-absorbing inorganic pigment.

<8> The recording medium according to <7>, wherein a weight ratio of the high oil-absorbing inorganic pigment to the binder resin is 80% to 200%.

<9> The recording medium according to any of <7> or <8>, wherein the high oil-absorbing inorganic pigment is silica particles having oil absorption of 150 mL/100 g to 350 mL/100 g.

<10> The recording medium according to any one of <1> to <9>, the antistatic agent-containing layer has a two layered structure consisting of a conductive functional layer comprising the tin oxide-coated titanium oxide particles and an inkjet functional layer comprising no tin oxide-coated titanium oxide particles.

<11> The recording medium according to any one of <1> to <10>, wherein the recording medium is an inkjet recording medium.

<12> The recording medium according to any one of <1> to <10>, further containing a thermosensitive recording layer disposed on the opposite surface of the support to the surface thereof where the antistatic agent containing layer is disposed, the thermosensitive recording layer containing a leuco dye and a developer.

<13> The recording medium according to <12>, further containing an under layer disposed between the support and the thermosensitive recording layer, the under layer containing hollow particles.

<14> The recording medium according to any of <12> or <13>, further containing an over layer disposed on the thermosensitive recording layer.

<15> The recording medium according to <14>, wherein the over layer contains tin oxide-coated titanium oxide particles.

<16> The recording medium according to any one of <12> to <15>, wherein the recording medium is a thermosensitive recording medium.

<17> The recording medium according to any one of <12> to <15>, wherein the recording medium is a thermosensitive-inkjet hybrid recording medium.

According to the present invention, there can be provided a recording medium which has high ink absorption, is excellent in water resistance, antistatic properties, and properties for preventing the powder from falling off, and is highly safe, and also a recording medium which has a small amount of the paper powder generated at the time of cutting, is excellent in safety without influencing the environment, exhibits a sufficient antistatic effect, is highly sensitive and excellent in storage stability, and water resistance.

DETAILED DESCRIPTION OF THE INVENTION (Recording Medium)

The recording medium of the present invention contains at least a support and an antistatic agent-containing layer disposed on the support, and may further contain other layers, if necessary.

Use of the recording medium is suitably selected depending on the intended purpose without any restriction, but it is suitable for an inkjet recording medium, a thermosensitive recording medium, a thermosensitive-inkjet hybrid recording medium or the like.

<Antistatic Agent-Containing Layer>

The antistatic agent-containing layer contains at least a binder resin and a tin oxide-coated titanium oxide particles, and may further contains other components such as a high oil-absorbing inorganic pigment, if necessary.

The antistatic agent-containing layer may be of a single layered structure, or a laminate structure of two or more layers.

The antistatic agent-containing layer is used as an ink-receiving layer in the case where the recording medium is an inkjet recording medium, is used as a back layer or over layer in the case where the recording medium is a thermosensitive recording medium, and is used as an ink-receiving layer and a back layer or over layer in the case where the recording medium is a thermosensitive-inkjet hybrid recording medium.

—Tin Oxide-Coated Titanium Oxide Particles—

The tin oxide-coated titanium oxide particles are used as an antistatic agent.

The use of the tin oxide-coated titanium oxide particles is advantageous, because the tin oxide-coated titanium oxide particles exhibit the effect thereof regardless of the temperature and humidity of the environment, without causing the aforementioned problems such as low image density or low water fastness, unlike organic antistatic agents.

Moreover, the tin oxide-coated titanium oxide particles are formed of an antimony-free conductive metal compound, and thus the use thereof is also advantageous in terms of safety.

The use of the tin oxide-coated titanium oxide particles is advantageous as the amount of tin oxide for use can be small. Tin oxide has a conducting function. By contacting tin oxide particles to each other, an electric conducting path is formed, to thereby give an antistatic function. Since the inner portion of the particle does not contribute to the conductivity, the amount of tin oxide for use can be reduced by using titanium oxide, which is highly safe, for the inner portion of the particle.

Moreover, as specific gravity of titanium oxide is large, the tin oxide-coated titanium oxide particles tend to locate at the bottom of the layer when coated in a wet condition. As a result, the contacts between the thin oxide-coated titanium oxide particles are increased and hence the antistatic function is easy to exhibit.

The method for producing the aforementioned titanium oxide coated with tin oxide is suitably selected depending on the intended purpose without any restriction. For example, to suspension of titanium oxide particles, an aqueous solution of a hydrolyzable tin compound such as tin chloride, an aqueous solution in which a water miscible organic solvent is mixed, or a solution of a water miscible organic solvent (especially suitable in the case where an alkoxy tin compound is used as the hydrolysable tin compound) is added; an aqueous solution in which a water miscible organic solvent is mixed (for the purpose of making a hydrolysis reaction mild and uniformly depositing a hydroxide product), is further added thereto, if necessary; alkali is added thereto so as to hydrolyze the tin compound and form a hydroxide product on a surface of each of the titanium oxide particles; and then the hydroxide product is transformed to an oxide product by baking or the like.

The titanium oxide coated with tin oxide is inexpensive, has no problem in terms of safety, and is capable of attaining an antistatic effect.

A volume average particle diameter of the tin oxide-coated titanium oxide particles is suitably selected depending on the intended purpose without any restriction, and is preferably 0.2 μm to 5.0 μm.

The volume average particle diameter is a value obtained by measuring a dispersion of the tin oxide-coated titanium oxide particles by means of a laser scattering particle distribution analyzer.

When the volume average particle diameter thereof is smaller than 0.20 μm, the tin oxide that coats the titanium oxide peels off and thus the antistatic effect may be lowered. When the volume average particle diameter thereof is larger than 5.0 μm, the pigment of high specific gravity, such as titanium oxide, is settled in a dispersion so that the coating liquid may become unstable or a wear amount of the cutter may be increased at the time of cutting the paper in the printer.

Moreover, the aforementioned titanium oxide coated with tin oxide attains a conductive effect by contacting the particles thereof to each other within the particles containing layer, and thus a contact between particles are spoiled when the particle diameter is too small or too large. For this reason, the volume average particle diameter of the tin oxide-coated titanium oxide particles is preferably 0.20 μm to 5.0 μm.

An amount of the tin oxide-coated titanium oxide particles is contained in the antistatic agent-containing layer is suitably adjusted depending on the intended purpose without any restriction, and is preferably 0.1 $g/m^2$ to 1.0 $g/m^2$.

When the amount of the tin oxide-coated titanium oxide particles contained in the antistatic agent-containing layer is smaller than 0.1 $g/m^2$, the antistatic effect tends to be low. In the case where the recording medium is an inkjet recording medium, even if more than 1.0 $g/m^2$ of the tin oxide-coated titanium oxide particles are added, an additional improvement for the antistatic effect cannot be largely expected, and smearing of images becomes recognizable as the proportion of the high oil-absorbing inorganic pigment is reduced. In the case where the recording medium is a thermosensitive recording medium, with addition of more than 1.0 $g/m^2$ of the tin oxide-coated titanium oxide particles, the wear amount of the cutter is increased at the time of cutting the paper in the printer.

In the case where the recording medium is an inkjet recording medium, an amount of the tin oxide-coated titanium oxide particles is suitably adjusted depending on the intended purpose without any restriction, and is preferably 5% to 50% of the antistatic agent-containing layer on a weight ratio.

As mentioned above, the tin oxide-coated titanium oxide particles form an electric conduction path by contacting the particles to each other in the particles containing layer to thereby attain a conductive effect. When the amount thereof is less than 5%, the number of the contacting points of the particles is reduced, and thus the antistatic function is lowered. When the amount thereof is more than 50%, smearing of images may be more recognizable at the time of inkjet recording as the proportion of the high oil-absorbing inorganic pigment is reduced, or the pigment component may be fallen off (hereinafter may be referred as powder falling) due to insufficient binding as the proportion of the binder resin is reduced. Accordingly, such amounts are not preferable.

Note that, an ionic conductive antistatic agent of anion, cation or nonion, a conductive conjugated polymer, and other antimony-free conductive inorganic pigments may be added in the amount small enough to adversely affect the water resistance, image density, antistatic properties, or increase in cost.

In the case where the recording medium is a thermosensitive recording medium, the antistatic agent-containing layer (hereinafter may be referred as a back layer) is disposed on the opposite surface of the support to the surface thereof where a thermosensitive recording layer is disposed.

The back layer is disposed so as to control the curling of the thermosensitive recording medium at the time when the thermosensitive recording surface of the support is coated, and to improve the conveyance performance of the printer, or so as to prevent the image density from lowering affected by the plasticizer contained in the adhesive when the thermosensitive recording medium is processed to be a label. The deposition amount of the back layer is suitably adjusted depending on the intended purpose without any restriction, and is preferably 0.1 $g/m^2$ to 10.0 $g/m^2$, more preferably 0.5 $g/m^2$ to 5.0 $g/m^2$.

The tin oxide-coated titanium oxide particles can be added to the surface of the support where the thermosensitive recording layer is disposed, but it is more preferably to add the same in the back layer in view of the influence to the image density or image preserving stability.

—Binder Resin—

The binder resin is suitably selected from the conventional water-soluble polymer and/or water-soluble polymer emulsion depending on the intended purpose without any restriction. Examples of the binder resin include: water-soluble polymers such as polyvinyl alcohol, e.g. diacetone-modified polyvinyl alcohol, itaconic acid-modified polyvinyl alcohol, carboxy-modified polyvinyl alcohol, starch and derivatives thereof, cellulose derivatives, e.g. hydroxymethyl cellulose, methoxy cellulose, hydroxyethyl cellulose, carboxymethyl cellulose, methyl cellulose, and ethyl cellulose, polysodium acrylate, polyvinyl pyrrolidone, acrylamide-acrylic acid ester copolymer, acrylamide-acrylic acid ester-methacrylic acid terpolymer, alkali salt of styrene-maleic anhydride copolymer, alkali salt of isobutylene-maleic anhydride copolymer, polyacryl amide, sodium alginate, gelatin, and casein; emulsions such as polyvinyl acetate, polyurethane, polyacrylate, polyester acrylate, polyester methacrylate, vinyl chloride-vinyl acetate copolymer, polybutyl methacrylate, and ethylene-vinyl acetate copolymer; and latexes such as styrene-butadiene copolymer, and styrene-butadiene-acryl copolymer. Among them, itaconic acid-modified polyvinyl alcohol is preferable as it can prevent powder falling.

The itaconic acid-modified polyvinyl alcohol is capable of easily forming sodium salts or the like as it contains carboxyl group as the modified group, and is ion-containing polyvinyl alcohol and thus is able to increase conductivity using together with the tin oxide-coated titanium oxide particles.

Moreover, it has been found by the inventors that the use of the itaconic acid-modified polyvinyl alcohol has a significant advantage because it increases the binding force between the tin oxide-coated titanium oxide particles used as an antistatic agent and the support, and reduces the amount of the paper powder generated from the thermosensitive recording medium in the case where the thermosensitive recording medium is cut at the outlet of the conveyance pathway of the printer and then used.

As a result, in the case where printing is continuously performed on the thermosensitive recording medium in the roll form, the amount of the paper powder generated at the time of cutting within the printer is reduced, and the amount of static electricity generated on the thermosensitive recording medium is reduced. Accordingly, printing image failures especially caused by the paper powder, which blocks the thermal energy transferred from the thermal head during image recording, are significantly improved.

—High Oil-Absorbing Inorganic Pigment—

In the case where the recording medium is an inkjet recording medium, the antistatic layer preferably contains a high oil-absorbing inorganic pigment.

The high oil-absorbing inorganic pigment is suitably selected from the conventional organic pigments used as fillers, without any restriction.

Examples of the inorganic pigment include: silicates such as silicon dioxide, kaolin, calcium silicate, magnesium silicate, aluminum silicate, zinc silicate, amorphous silica; and inorganic pigments such as zinc oxide, aluminum oxide, titanium dioxide, aluminum hydroxide, barium sulfate, talc, clay, magnesium oxide, magnesium hydroxide, calcium carbonate, and magnesium carbonate. These pigments may be used in combination, if necessary.

Especially, the fillers having large oil absorption, such as silicon dioxide, kaolin, calcium carbonate, and the like are desirable, as these absorb an inkjet ink, and the preferred are silica particles having the oil absorption of 150 mL/100 g to 350 mL/100 g.

When the oil absorption is less than 150 mL/100 g, the ink absorption amount becomes small, and thus it may cause bleeding of inkjet images, or in the worst case, it may cause background depositions as the drying speed is slow and thus the ink is smeared.

Moreover, when the oil absorption is more than 350 mL/100 g, it provides desirable properties to inkjet, but at the time when the coating liquid is prepared for coating the support during the production, the stability of the coating liquid may become unstable as the water absorption is too large.

Furthermore, the weight ratio of the high oil-absorbing inorganic pigment is preferably 80% to 200% with respect to the binder resin.

When it is less than 80%, the absorption amount of the ink is low and thus bleeding of an inkjet image is occurred easily. When it is more than 200%, it may cause the powder to fall off due to a weak binding force.

—Other Components (Additives)—

The recording medium of the present invention may further contain other components.

Examples of other components include a surfactant for improving coating ability or dispersion stability, a mordant for fixing an inkjet image, and a lubricant for improving conveyance performance or abrasion resistance.

Examples of the surfactant include metal soaps of fatty acid, polycarboxylic acid polymer activators, sulfuric acid ester salts of higher alcohol, sulfuric acid ester salts of alkyl polyether, ethylene oxide adducts of higher alcohol, alkyl aryl sulfonates, alkyl sulfonates, aryl sulfonates, phosphoric acid esters, aliphatic phosphoric acid esters, aromatic phosphoric acid esters, polyoxyethylene alkyl sulfates, polyoxyethylene aryl sulfates, polyoxyethylene alkylaryl sulfates, dialkyl sulfosuccinates, alkyl benzene sulfonates, polyoxyalkylene alkyl ether phosphates, polyoxyalkylene aryl ether phosphates, polyoxyalkylene alkylaryl ether phosphates, sodium alkyl sulfates, dioctyl sodium sulfosuccinate, polyalkylene glycol (e.g., polyoxyethylene nonylphenyl ether), acetylene glycol, ethylene oxide adducts of acetylene glycol, propylene oxide adducts of acetylene glycol, and ethylene oxide and propylene oxide adducts of acetylene glycol.

As the mordant, cationic resins or surfactants are generally added as the inkjet ink is negatively charged in most cases. Specific examples of the mordant are those listed in JP-A No. 2006-240287.

Examples of the lubricant includes higher fatty acid and metal salts thereof, higher fatty acid amide, higher fatty acid ester, and various wax such as animal wax, vegetable wax, mineral wax and petroleum wax.

—Conductive Functional Layer, Inkjet Functional Layer—

In the case where the recording medium is an inkjet recording medium, it is preferable that the antistatic agent-containing layer is formed of two layers, a conductive functional layer and an inkjet functional layer, for the purpose of enhancing suitability for inkjet and an antistatic effect.

The conductive functional layer is a layer containing the tin oxide-coated titanium oxide particles.

The inkjet functional layer is a layer which does not contains the tin oxide-coated titanium oxide particles.

As a result of the two-layered structure, the antistatic agent-containing layer is capable of exhibiting a high antistatic function with a small amount of an expensive conductive inorganic pigment. More preferable structure is such that the conductive functional layer is disposed on the support, and the inkjet functional layer is disposed on the conductive functional layer.

<Support>

The support is suitably selected depending on the intended purpose without any restriction, and is preferably selected from a paper base, a nonwoven fabric base, a synthetic paper base, and a resin film base.

As the support, a paper base using pulp as a main material has been commonly used, but other examples which can be used include: polyester films such as polyethylene terephthalate, and polybutylene terephthalate; cellulose derivative films such as cellulose triacetate; polyolefin films such as polypropylene, and polyethylene; polystyrene films; nonwoven fabric; and laminates thereof.

A plastic base of a synthetic paper mainly formed of polypropylene or the like can be also used as the support.

Since the support, especially using a plastic base, tends to generate static electricity during the conveyance in the printer, the antistatic agent-containing layer for use in the present invention exhibits a significant effect to reduce static electricity.

<Thermosensitive Recording Layer>

The recording medium may contain a thermosensitive recording layer on the opposite surface of the support to the surface thereof where the antistatic agent-containing layer is disposed.

By containing the thermosensitive recording layer, the recording medium can be used as a thermosensitive recording medium.

The thermosensitive recording medium contains at least a leuco dye and a developer, and may further contain other components, if necessary.

In the thermosensitive recording medium for use in the present invention, any coloring substance which induces a coloring reaction by heat can be arbitrarily selected and used. However, it is more preferable that the thermosensitive recording layer contains, as a main component thereof, coloring substances consisting of a leuco dye, which is generally colorless or slightly tinted, and a developer which colors the dye at the time when heat is applied, as it excels in coloring sensitivity and color density.

—Leuco Dye—

Such leuco dye is suitably selected from those generally used in a thermosensitive recording layer, and suitable examples thereof include leuco compounds of triphenyl methane dyes, fluoran dyes, phenothiazine dyes, auramine dyes, spiropyran dyes, and indolino-phthalide dyes.

Specific examples of the leuco dye are 3,3-bis(p-dimethylaminophenyl)-phthalide, 3,3-bis(p-dimethylaminophenyl)-6-dimethylaminophthalide (i.e. crystal violet lactone), 3,3-bis(p-dimethylaminophenyl)-6-diethylaminophthalide, 3,3-bis(p-dimethylaminophenyl)-6-chlorophthalide, 3,3-bis(p-dibutylaminophenyl)phthalide, 3-cyclohexylamino-6-chlorofluorane, 3-dimethylamino-5,7-dimethylfluoran, 3-(N-methylN-isobutylamino)-6-methyl-7-anilinofluoran, 3-(N-ethyl-N-isoamylamino)-6-methyl-7-anilinofluoran, 3-diethylamino-7-chlorofluoran, 3-diethylamino-7-methylfluoran, 3-diethylamino-7,8-benzfluoran, 3-diethylamino-6-methyl-7-chlorofluoran, 8-(N-p-toryl-N-ethylamino)-6-methyl-7-anilinofluoran, 3-pyrrolidino-6-methyl-7-anilinofluoran, 2-[N-(3'-trifluoromethylphenyl)amino]-6-diethylaminofluoran, 2-[3,6-bis(diethylamino)-9-(o-chloroanilino)xanthyl]benzoic acid lactam, 3-diethylamino-6-methyl-7-(m-trichloromethylanilino)fluoran, 3-dimethylamino-7-(o-chloroanilino)fluoran, 3-dibutylamino-7-(o-chloroanilino)fluoran, 3-N-methyl-N-amylamino-6-methyl-7-anilinofluoran, 3-N-methyl-N-cyclohexylamino-6-methyl-7-anilinofluoran, 3-diethylamino-6-methyl-7-anilinofluoran, 3-diethylamino-6-methyl-7-(2',4'-dimethylanilino)fluoran, 3-(N,N-diethylamino)-5-methyl-7-(N,N-benzylamino)fluoran, benzyl leuco methylene blue, 6'-chloro-8'-methoxy-benzindolino-spiropyran, 6'-bromo-3'-methoxybenzindolinospiropyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-diethylaminophenyl)-3-(2'-methoxy-5'-methylphenyl)phthalide, 3-(2'-methoxy-4'-dimethylaminophenyl)-3-(2'-hydroxy-4'-chloro-5'-methyl phenyl)phthalide, 3-morpholino-7-(N-propyl-trifluoromethylanilino)fluoran, 3-pyrrolidino-7-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino)fluoran, 3-(N-ethyl-p-toluidino)-7-(α-phenylethylamino)fluoran, 3-diethylamino-7-(o-methoxycarbonylphenylamino)fluoran, 3-diethylamino-5-methyl-7-(α-phenylethylamino)fluoran, 3-diethylamino-7-piperidinofluoran, 2-chloro-3-(N-methyl-toluidino)-7-(p-n-butylanilino)fluoran, 3-(N-methyl-N-isopropylamino)-6-methyl-7-anilinofluoran, 3-dibutylamino-6-methyl-7-anilinofluoran, 3,6-bis(dimethylamino) fluorinespiro(9,3')-6'-dimethylaminophthalide, 3-(N-benzyl-N-cyclohexylamino)-5,6-benz-7-α-naphthylamino-4'-bromofluoran, 3-diethylamino-6-chloro-7-anilinofluoran, 3-N-ethyl-N-(2-ethoxydipropyl)-amino-6-methyl-7-anilinofluoran, 3-N-ethyl-N-tetrahydrofurfurylamino-6-methyl-7-anilinofluoran, 3-diethylamino-6-methyl-7-mesidino-4',5'-benzfluoran, 3-(p-dimethylaminophenyl)-3-[1,1-bis(p-dimethylaminophenyl)ethylen-2-yl]phthalide, 3-(p-dimethylaminophenyl)-3[1,1-bis(p-dimethylaminophenyl) ethylene-2-yl]-6-dimethylaminophthalide, 3-(p-dimethylaminophenyl)-3-(1-p-dimethylaminophenylethylen-2-yl)phthalide, 3-(p-dimethylaminophenyl)-3-(1-p-dimethylaminophenyl-1-p-chloro phenylethylen-2-yl)-6-dimethylaminophthalide, 3-(4'-dimethylamino-2'-methoxy)-3-(1"-p-dimethylaminophenyl-1"-p-chlorophenyl-1",3"-butadien-4"-1-yl)benzphthalide, 3-(4'-dimethylamino-2'-benzyloxy)-3-(1"-p-dimethylaminophenyl-1"-phenyl-1",3"-butadien-4"-yl) benzphthalide, 3-dimethylamino-6-dimethylaminofluorene-9-spiro-3'-(6'-dimethylamino)phthalide, 3,3-bis[2-(p-dimethylaminophenyl)-2-(p-methoxyphenyl)ethenyl]-4,5,6,7-tetrachlorophthalide, 3-bis[1,1-bis(4-pyrrolidinophenyl) ethylen-2-yl]-5,6-dichloro-4,7-dibromophthalide, bis(p-dimethylaminostyryl)-1-napthalenesulfonylmethane, and the like.

The leuco dye may be used independently or in combination.

—Developer—

As the developer for use in the present invention, various electron-accepting compounds, such as phenol compounds, thiophenol compounds, thiourea derivatives, organic acids, and metal salts thereof, can be used. Specific examples thereof include 4,4'-isopropylidene bisphenol, 4,4'-isopropylidene bis(o-methylphenol), 4,4'-sec-butylidene bisphenol, 4,4'-isopropylidene bis(2-tert-butylphenol), 4,4'-cyclohexylidne diphenol, 4,4'-isopropylidene bis(2-chlorophenol), 2,2'-methylene bis(4-methyl-6-tert-butylphenol), 2,2'-methylene bis(4-ethyl-6-tert-butylphenol), 4,4'-butylidene bis(6-tert-butyl-2-methylphenol), 1,1,3-tris(2-methyl-4-hydroxy-5-tert-butylphenyl)butane, 1,1-3-tris(2-methyl-4-hydroxy-5-cyclohexylphenyl)butane, 4,4'-thiobis(6-tert-butyl-2-methylphenol), 4,4'-diphenol sulfone, 4-isopropoxy-4'-hydroxydiphenyl sulfone, 4-benzyloxy-4'-hydroxydiphenyl sulfone, 4,4'-diphenol sulfoxide, isopropyl p-hydroxybenzonate, benzyl p-hydroxybenzonate, protocatechuic acid benzyl ester, stearyl gallate, lauryl gallate, octyl gallate, 1,3-bis(4-hydroxyphenyl thio)-propane, 1,8-bis(4-hydroxyphenyl thio)-2-hydroxy propane, N,N'-diphenyl thiourea, N,N'-di(m-chlorophenyl)thiourea, salicylanilide, 5-chlorosalicylanilide, methyl bis(4-hydroxydiphenyl)acetate, benzyl bis(4-hydroxyphenyl)acetate, 1,3-bis(4-hydroxycumyl)benzene, 1,4-bis(4-hydroxychloro)benzene, 2,4'-diphenyl sulfone, 2,2'-diallyl-4,4'-diphenol sulfone, 3,4-dihydroxy-4'-methyldiphenyl sulfone, zinc 1-acetyloxy-2-naphthoate, zinc 2-acetyloxy-1-naphthoate, zinc 2-acetyloxy-3-naphthoate, α,α-bis(4-hydroxydiphenyl)-α-methyl toluene, antipyrine complex of zinc thiocyanate, tetrabromo bisphenol A, tetrabromo bisphenol S, a diphenyl sulfone cross-linked compound represented by the following general formula 1, and urea-urethane derivative compound represented by the following general formula 2:

General Formula 1

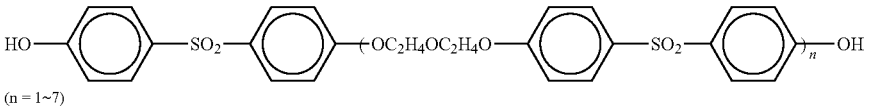

In General Formula 1, n represents an integer of 1 to 7.

General Formula 2

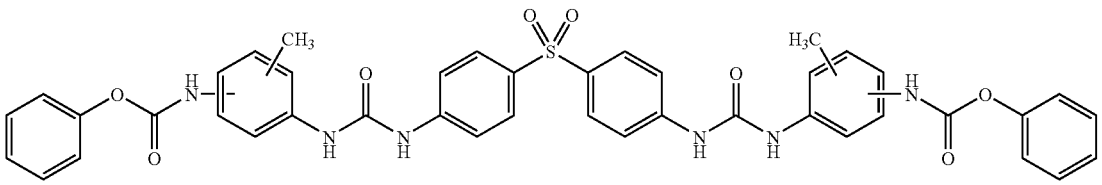

—Other Components—

In the present invention, conventionally used various binders can be arbitrarily selected and used to combine and support the leuco dye and the developer on the support.

Specific examples thereof include: water-soluble polymers such as polyvinyl alcohol, carboxy-modified polyvinyl alcohol, starch and derivatives thereof, cellulose derivatives, e.g. methoxy cellulose, hydroxyethyl cellulose, carboxymethyl cellulose, methyl cellulose, and ethyl cellulose, polysodium acrylate, polyvinyl pyrrolidone, acrylamide-acrylic acid ester copolymer, acrylamide-acrylic acid ester-methacrylic acid terpolymer, alkali salt of styrene-maleic anhydride copolymer, alkali salt of isobutylene-maleic anhydride copolymer, polyacryl amide, sodium alginate, gelatin, and casein; emulsions such as polyvinyl acetate, polyurethane, polyester acrylate, polyester methacrylate, vinyl chloride-vinyl acetate copolymer, and ethylene-vinyl acetate copolymer; and latexes such as styrene-butadiene copolymer, and styrene-butadiene-acryl copolymer.

Moreover, in combination with the leuco dye and the developer, various supplemental additive substances, which are conventionally used for a thermosensitive recording layer, may be used. Examples thereof include fillers, surfactants, thermoplastic materials (or lubricants) and the like.

In this case, examples of the fillers include: inorganic powder such as powder of calcium carbonate, silica, zinc oxide, titanium oxide, aluminum hydroxide, zinc hydroxide, barium sulfate, clay, talc, or surface-treated calcium or silica; and organic powder such as powder of urea-formalin resin, styrene-methacylic acid copolymer, or polystyrene resin.

Examples of the thermoplastic materials include those having a melting point of approximately 50° C. to 200° C., such as higher fatty acid or ester thereof, amid or metal salt thereof, various wax, condensation products of aromatic carboxylic acid and amine, phenyl benzoate, higher linear glycol, dialkyl 3,4-epoxy-hexahydrophthalate, higher ketone, and other thermoplastic organic compounds.

In the present invention, the thermosensitive recording layer can be formed by dispersing a thermosensitive coloring substance, e.g. a generally colorless or slightly tinted leuco dye, a developer, a binder, and arbitrarily added supplemental additives in water so as to prepare a coating liquid of the thermosensitive recording layer, applying the coating liquid onto a support, and drying.

<Over Layer (Protective Layer)>

The recording medium of the present invention preferably further contains an over layer mainly formed of a water-soluble resin disposed on the thermosensitive recording layer for improving anti-plasticizer and anti-oil properties of the colored images. Specific examples of the water-soluble resin include those listed as the water-soluble polymer binder in connection with the thermosensitive recording layer.

The over layer may contain tin oxide-coated titanium oxide particles.

For improving the water resistance of the over layer, the water-soluble resin is preferably used in combination with the conventional water proof agent that provides water resistant properties to the water-soluble resin. Specific examples of the water proof agent include hormaldehyde, glyoxal, chloroalum, melamine, melamine-hormaldehyde resin, polyamide resin, and polyamide-epichlorohydrin resin. Moreover, the over layer preferably further contains the conventional supplemental additives such as fillers, thermoplastic materials (lubricants) and surfactants, for preventing a thermal head from sticking, if necessary. Specific examples of the fillers and the thermoplastic materials are those listed in connection with the thermosensitive recording layer. The over layer for use in the present invention can be formed by using an aqueous solution of a water-soluble resin, or adding water proof agent, filler, a thermoplastic material (a lubricant), a surfactant and the like to the aqueous solution of the water-soluble resin so as to prepare a coating liquid, applying the coating liquid onto the thermosensitive recording layer, and drying.

<Under Layer (Thermal Insulating Layer)>

In the present invention, as mentioned earlier, the recording medium preferably contains an under layer mainly formed of hollow particles for improving the sensitivity of the coloring layer (the thermosensitive recording layer).

As hollow particles, for example, those having shells of a thermoplastic resin, each having hollowness of 30% or more (within the range of 33% to 99%), and having the volume average particle diameter of 0.4 μm to 10 μm can be used.

Here, the hollowness is a ratio of the outer diameter of the hollow particle to the inner diameter thereof, and represented by the formula: (an inner diameter of a hollow particle/an outer diameter of a hollow particle)×100%.

The under layer is formed in the deposition amount of 2 $g/m^2$ to 10 $g/m^2$ on the dry basis. It is preferable that the under layer contains the hollow particles having the hollowness of 80% or more and the volume average particle diameter of 2 μm to 10 μm, and has a weight of 2.5 $g/m^2$ to 7 $g/m^2$ on the dry basis.

Such the hollow particles are contained in the formulation of the under layer in the weight ratio of 35% to 80%. The contained amount of the hollow particles in terms of the weight ratio is reduced as the hollowness thereof increases because of the change in the specific gravity related to the hollowness, but when the contained amount thereof is less than 35%, the effect for attaining the sensitivity cannot be easily exhibited, and when the amount thereof is more than 80%, the binding of the layers may be impaired.

The under layer containing the hollow particles realizes the improvement of the sensitivity, but such the under layer increases the accumulation of the charged amount in the thermosensitive recording medium at the same time. Therefore, it is effective that it is used together with the back layer and over layer containing the tin oxide-coated titanium particles that function as an antistatic agent in the present invention.

—Thermosensitive-Inkjet Hybrid Recording Medium—

By forming a thermosensitive recording layer on an opposite surface of the support to the surface where the antistatic agent-containing layer is disposed, the recording medium becomes a hybrid recording medium having both recording performances of inkjet recording and thermosensitive recording.

EXAMPLES

Hereinafter, the present invention will be specifically explained with reference to examples and comparative examples thereof, but the examples shall not be construed to limit the scope of the present invention.

In the following examples and comparative examples, all parts and % are on weight basis.

Example A-1

Preparation of a Coating Liquid of an Antistatic Agent-Containing Layer

A mixture consisting of the following formulation were dispersed by means of a homomixer to thereby prepare [A1 liquid].

| [A1 liquid] | |
|---|---|
| Amorphous silica (SYLYSIA 430, manufactured by Fuji Silysia Chemical Ltd., having oil absorption of 220 mL/100 g) | 20 parts |
| Surfactant | 1 part |
| Water | 80 parts |

A mixture consisting of the following formulation were dispersed by means of a sand grinder so as to have a volume average particle diameter of 0.9 μm to thereby prepare [B1 liquid].

| [B1 liquid] | |
|---|---|
| Tin oxide-coated titanium oxide particles (W-4, manufactured by Mitsubishi Materials Corporation) | 20 parts |
| 10% polyvinyl alcohol aqueous solution | 20 parts |
| Water | 60 parts |

Then, a coating liquid of the antistatic agent-containing layer was prepared by using [A1 liquid] and [B1 liquid] and mixing the same with the formulation presented below, and the prepared coating liquid was applied on a commercial fine paper (basis weight of 80 g/m$^2$) by means of a Labo coating machine and dried so as to have a deposition amount of 5.0 g/m$^2$ on the dry basis to thereby prepare paper coated with an antistatic agent-containing layer.

| [Coating liquid of an antistatic agent-containing layer] | |
|---|---|
| [A1 liquid] | 50 parts |
| [B1 liquid] | 20 parts |
| 10% completely saponificated polyvinyl alcohol aqueous solution | 100 part |
| 25% polyamide epichlorohydrin aqueous solution | 12 parts |

Example A-2

The inkjet recording medium of Example A-2 was prepared in the same manner as in Example A-1, provided that a volume average particle diameter of [B1 liquid] was adjusted to 0.2

Example A-3

The inkjet recording medium of Example A-3 was prepared in the same manner as in Example A-1, provided that a volume average particle diameter of [B1 liquid] was adjusted to 0.1 μm.

Example A-4

The inkjet recording medium of Example A-4 was prepared in the same manner as in Example A-1, provided that a volume average particle diameter of [B1 liquid] was adjusted to 5

Example A-5

The inkjet recording medium of Example A-5 was prepared in the same manner as in Example A-1, provided that a volume average particle diameter of [B1 liquid] was adjusted to 7 μm.

Example A-6

The inkjet recording medium of Example A-6 was prepared in the same manner as in Example A-1, provided that an amount of [B1 liquid] to be added was changed to 6 parts.

Example A-7

The inkjet recording medium of Example A-7 was prepared in the same manner as in Example A-1, provided that an amount of [B1 liquid] to be added was changed to 4 parts.

Example A-8

The inkjet recording medium of Example A-8 was prepared in the same manner as in Example A-1, provided that an amount of [B1 liquid] to be added was changed to 125 parts.

Example A-9

The inkjet recording medium of Example A-9 was prepared in the same manner as in Example A-1, provided that an amount of [B1 liquid] to be added was changed to 200 parts.

Example A-10

The inkjet recording medium of Example A-10 was prepared in the same manner as in Example A-1, provided that an amount of [A1 liquid] to be added was changed to 40 parts.

Example A-11

The inkjet recording medium of Example A-11 was prepared in the same manner as in Example A-1, provided that an amount of [A1 liquid] to be added was changed to 30 parts.

Example A-12

The inkjet recording medium of Example A-12 was prepared in the same manner as in Example A-1, provided that an amount of [A1 liquid] to be added was changed to 100 parts.

Example A-13

The inkjet recording medium of Example A-13 was prepared in the same manner as in Example A-1, provided that an amount of [A1 liquid] to be added was changed to 125 parts.

Example A-14

The inkjet recording medium of Example A-14 was prepared in the same manner as in Example A-1, provided that amorphous silica contained in [A1 liquid] was replaced with those having oil absorption of 150 mL/100 g (MIZUKASIL P-527, manufactured by MIZUSAWA INDUSTRIAL CHEMICALS, LTD.).

Example A-15

The inkjet recording medium of Example A-15 was prepared in the same manner as in Example A-1, provided that amorphous silica contained in [A1 liquid] was replaced with those having oil absorption of 110 mL/100 g (MIZUKASIL P-603, manufactured by MIZUSAWA INDUSTRIAL CHEMICALS, LTD.).

Example A-16

The inkjet recording medium of Example A-16 was prepared in the same manner as in Example A-1, provided that amorphous silica contained in [A1 liquid] was replaced with those having oil absorption of 350 mL/100 g (SYLYSIA 350, manufactured by Fuji Silysia Chemical Ltd.).

Example A-17

The inkjet recording medium of Example A-17 was prepared in the same manner as in Example A-1, provided that amorphous silica contained in [A1 liquid] was replaced with those having oil absorption of 400 mL/100 g (a test model).

Example A-18

The inkjet recording medium of Example A-18 was prepared in the same manner as in Example A-1, provided that completely saponificated polyvinyl alcohol contained in [Coating liquid of an antistatic agent-containing layer] was replaced with itaconic acid-modified polyvinyl alcohol.

Example A-19

[Coating liquid of a conductive functional layer] and [Coating liquid of an inkjet functional layer] were respectively prepared by mixing and stirring each of chemical solutions presented in the following formulations.

| [Coating liquid of a conductive functional layer] | |
|---|---|
| [A1 liquid] | 20 parts |
| [B1 liquid] | 30 parts |
| 10% itaconic acid-modified polyvinyl alcohol aqueous solution | 100 part |
| 25% polyamide epichlorohydrin aqueous solution | 12 parts |
| [Coating liquid of an inkjet functional layer] | |
| [A1 liquid] | 50 parts |
| 10% itaconic acid-modified polyvinyl alcohol aqueous solution | 100 part |
| 25% polyamide epichlorohydrin aqueous solution | 12 parts |

The prepared [Coating liquid of a conductive functional layer] was applied and dried on a commercial fine paper (basis weight of 80 g/m$^2$) by means of a Labo coating machine so as to have a deposition amount of 1.6 g/m$^2$ on the dry basis, and then the prepared [Coating liquid of an inkjet functional layer] was applied and dried thereon so as to have a deposition amount of 3.4 g/m$^2$ to thereby an inkjet recording medium of Example A-19 in which the antistatic agent-containing layer had a two-layered structure and was functionally separated.

Comparative Example A-1

The inkjet recording medium of Comparative Example A-1 was prepared in the same manner as in Example A-1, provided that [B1 liquid] was not added therein.

Comparative Example A-2

The inkjet recording medium of Comparative Example A-2 was prepared in the same manner as in Example A-1, provided that the tin oxide-coated titanium oxide particles contained in [B1 liquid] were replaced with aluminum-doped zinc oxide (23-K, manufactured by HakusuiTech Co., Ltd.).

Comparative Example A-3

The inkjet recording medium of Comparative Example A-3 was prepared in the same manner as in Example A-1, provided that [B1 liquid] was replaced with 10 parts of a cationic resinous antistatic agent (CHEMISTAT 7005, manufactured by Sanyo Chemical Industries, Ltd., having a solid content of 40%).

Comparative Example A-4

The inkjet recording medium of Comparative Example A-4 was prepared in the same manner as in Example A-1, provided that [B1 liquid] was replaced with 4 parts of a nonionic surfactant (low molecular weight) antistatic agent (EMULGEN 404, manufactured by Kao Corporation, having a solid content of 100%).

The composition of the materials of each of Examples A-1 to A-19 and Comparative Examples A-1 to A-4 are summarized in Table 1-1, Table 1-2 below.

TABLE 1-1

| | Inorganic pigment | | | Conductive material | | | |
|---|---|---|---|---|---|---|---|
| | Type — | Oil absorption mL/100 g | Ratio % | Type — | Average particle diameter μm | Deposition amount g/m$^2$ | Proportion in the layer % |
| Ex. A-1 | SYLYSIA 430 | 220 | 100 | Tin oxide-coated titanium oxide particles | 0.9 | 0.7 | 15 |
| Ex. A-2 | SYLYSIA 430 | 220 | 100 | | 0.2 | 0.7 | 15 |
| Ex. A-3 | SYLYSIA 430 | 220 | 100 | | 0.1 | 0.7 | 15 |
| Ex. A-4 | SYLYSIA 430 | 220 | 100 | | 5 | 0.7 | 15 |
| Ex. A-5 | SYLYSIA 430 | 220 | 100 | | 7 | 0.7 | 15 |
| Ex. A-6 | SYLYSIA 430 | 220 | 100 | | 0.9 | 0.25 | 5 |
| Ex. A-7 | SYLYSIA 430 | 220 | 100 | | 0.9 | 0.17 | 3 |
| Ex. A-8 | SYLYSIA 430 | 220 | 100 | | 0.9 | 2.5 | 50 |
| Ex. A-9 | SYLYSIA 430 | 220 | 100 | | 0.9 | 3 | 60 |
| Ex. A-10 | SYLYSIA 430 | 220 | 80 | | 0.9 | 0.7 | 15 |
| Ex. A-11 | SYLYSIA 430 | 220 | 60 | | 0.9 | 0.7 | 15 |
| Ex. A-12 | SYLYSIA 430 | 220 | 200 | | 0.9 | 0.7 | 15 |
| Ex. A-13 | SYLYSIA 430 | 220 | 250 | | 0.9 | 0.7 | 15 |
| Ex. A-14 | P-527 | 150 | 100 | | 0.9 | 0.7 | 15 |
| Ex. A-15 | P-603 | 110 | 100 | | 0.9 | 0.7 | 15 |
| Ex. A-16 | SYLYSIA 350 | 350 | 100 | | 0.9 | 0.7 | 15 |
| Ex. A-17 | Test model | 400 | 100 | | 0.9 | 0.7 | 15 |

TABLE 1-1-continued

| | | Inorganic pigment | | | Conductive material | | | |
|---|---|---|---|---|---|---|---|---|
| | | Type — | Oil absorption mL/100 g | Ratio % | Type — | Average particle diameter μm | Deposition amount g/m$^2$ | Proportion in the layer % |
| Ex. A-18 | | SYLYSIA 430 | 220 | 100 | | 0.9 | 0.7 | 15 |
| Ex. A-19 | (First layer) | SYLYSIA 430 | 220 | 100 | | 0.9 | 0.4 | 25 |
| | (Second layer) | SYLYSIA 430 | 220 | 100 | None | — | 0 | 0 |
| Comp. Ex. A-1 | | SYLYSIA 430 | 220 | 100 | None | — | 0 | — |
| Comp. Ex. A-2 | | SYLYSIA 430 | 220 | 100 | Al-doped zinc oxide | 0.9 | 0.7 | 15 |
| Comp. Ex. A-3 | | SYLYSIA 430 | 220 | 100 | Cationic resin | — | 0.7 | 15 |
| Comp. Ex. A-4 | | SYLYSIA 430 | 220 | 100 | Nonionic surfactant | — | 0.7 | 15 |

TABLE 1-2

| | | Binder resin Type | Other conditions |
|---|---|---|---|
| | | — | — |
| Ex. A-1 | | Completely saponificated PVA | |
| Ex. A-2 | | Completely saponificated PVA | |
| Ex. A-3 | | Completely saponificated PVA | |
| Ex. A-4 | | Completely saponificated PVA | |
| Ex. A-5 | | Completely saponificated PVA | |
| Ex. A-6 | | Completely saponificated PVA | |
| Ex. A-7 | | Completely saponificated PVA | |
| Ex. A-8 | | Completely saponificated PVA | |
| Ex. A-9 | | Completely saponificated PVA | |
| Ex. A-10 | | Completely saponificated PVA | |
| Ex. A-11 | | Completely saponificated PVA | |
| Ex. A-12 | | Completely saponificated PVA | |
| Ex. A-13 | | Completely saponificated PVA | |
| Ex. A-14 | | Completely saponificated PVA | |
| Ex. A-15 | | Completely saponificated PVA | |
| Ex. A-16 | | Completely saponificated PVA | |
| Ex. A-17 | | Completely saponificated PVA | |
| Ex. A-18 | | Itaconic acid-modified PVA | |
| Ex. A-19 | (First layer) | Itaconic acid-modified PVA | Two layered structure |
| | (Second layer) | Itaconic acid-modified PVA | |
| Comp. Ex. A-1 | | Completely saponificated PVA | |
| Comp. Ex. A-2 | | Completely saponificated PVA | |
| Comp. Ex. A-3 | | Completely saponificated PVA | |
| Comp. Ex. A-4 | | Completely saponificated PVA | |

The thus prepared inkjet recording medium was evaluated in the following manner. The results are shown in Table 2.

<Inkjet Properties>

The thus obtained inkjet recording medium was subjected to printing of a black solid pattern, a lattice pattern having a print image ratio of 50%, and a barcode pattern by means of a commercial inkjet printer (PM-A700, manufactured by SEIKO EPSON CORPORATION), and then dried. Thereafter, the printed inkjet recording medium was evaluated as follows.

1. Image Density

The image density of the printed black solid pattern was measured by means of a Macbeth optical densitometer RD-914 and a gray level thereof was recorded.

2. Bleeding

On the printed sample of the lattice pattern, the degree of bleeding of the printed portion was evaluated based on the following criteria.

A: no bleeding, or no ink flow

B: slight bleeding and ink flow were observed, but levels thereof were not problematic in view of the image quality C: bleeding and ink flow were observed, and levels thereof were problematic in view of the image quality 3. Water Resistance The printed sample of the barcoade pattern was immersed in water at 20° C. for 10 minutes, and thereafter the surface of the printed sample was rubbed with a finger for 10 times. The condition of the smeared image and the condition of the lowered color density were evaluated based upon the following criteria:

A: no ink was come off, and no bleeding or smearing

B: no ink was come off, but slight bleeding or smearing

C: some ink was come off, and the density was slightly lowered

D: the ink was come off, and the density was largely lowered

<Amount of Charge>

The thus prepared inkjet recording medium was conveyed by using a thermosensitive printer (96 Xi III plus, manufactured by Zebra Technologies Corporation) at a conveyance speed of 4 ips, and the charged amount (V) of the inkjet recording medium at the outlet roller part was measured by ELECTROSTATIC VOLTMETER (MODEL 542, manufactured by TREK Japan KK). This evaluation test was carried out at the temperature of 23° C., and humidity of 50%.

<Powder Falling>

The prepared inkjet recording medium was cut into a piece having a width of 3 cm, and the cut piece was then torn by hand for 200 times and the amount of paper powder generated during tearing was visually observed.

A: no paper powder was generated

B: paper powder was slightly generated

C: paper powder was generated at a large amount

TABLE 2

| | Inkjet properties | | | Antistatic properties | Others |
|---|---|---|---|---|---|
| | Density | Bleeding | Water resistance | Charged amount | Powder falling |
| Ex. A-1 | 1.37 | A | A | 3.2 KV | B |
| Ex. A-2 | 1.37 | B | A | 3.4 KV | B |
| Ex. A-3 | 1.36 | B | A | 3.8 KV | B |
| Ex. A-4 | 1.37 | B | A | 3.3 KV | B |
| Ex. A-5 | 1.38 | B | A | 3.2 KV | B |
| Ex. A-6 | 1.44 | B | A | 3.5 KV | B |
| Ex. A-7 | 1.47 | B | A | 3.9 KV | B |
| Ex. A-8 | 1.35 | B | A | 2.4 KV | B |
| Ex. A-9 | 1.34 | B | A | 2.2 KV | B |
| Ex. A-10 | 1.35 | B | B | 2.9 KV | A |

TABLE 2-continued

| | Inkjet properties | | | Antistatic properties | Others |
|---|---|---|---|---|---|
| | Density | Bleeding | Water resistance | Charged amount | Powder falling |
| Ex. A-11 | 1.33 | B | B | 3.1 KV | A |
| Ex. A-12 | 1.43 | B | A | 3.6 KV | B |
| Ex. A-13 | 1.47 | B | A | 3.7 KV | B |
| Ex. A-14 | 1.35 | B | A | 3.2 KV | A |
| Ex. A-15 | 1.33 | B | A | 3.2 KV | A |
| Ex. A-16 | 1.53 | A | A | 3.3 KV | B |
| Ex. A-17 | 1.60 | A | A | 3.3 KV | B |
| Ex. A-18 | 1.36 | B | A | 3.1 KV | A |
| Ex. A-19 | 1.51 | A | A | 2.5 KV | B |
| Comp. Ex. A-1 | 1.36 | B | A | 8.5 KV | B |
| Comp. Ex. A-2 | 1.37 | B | A | 6.4 KV | B |
| Comp. Ex. A-3 | 1.12 | B | D | 2.1 KV | A |
| Comp. Ex. A-4 | 1.24 | C | D | 2.9 KV | B |

Example B-1

Preparation of a Coating Liquid of a Thermosensitive Recording Layer

The mixture of the following formulation was pulverized and dispersed by means of a sand mill so as to have an average particle diameter of 1 μm.

| (A2 liquid) | |
|---|---|
| 3-dibutylamino-6-methyl-7-anilinofluoran | 20 parts |
| 10% polyvinyl alcohol aqueous solution | 20 parts |
| Water | 60 parts |
| (B2 liquid) | |
| 4-hydroxyphenyl-4'-isopropoxyphenylsulfone | 10 parts |
| di(p-methylbenzyl)oxalate | 4 parts |
| 10% polyvinyl alcohol aqueous solution | 10 parts |
| Water | 76 parts |
| (C2 liquid) | |
| Calcium carbonate | 20 parts |
| 10% polyvinyl alcohol aqueous solution | 10 parts |
| Water | 70 parts |

A coating liquid of a thermosensitive recording layer in which A2 liquid, B2 liquid and C2 liquid were mixed in the ratio of 2/7/6, was applied on one surface of a commercial fine paper (basis weight of 80 g/m$^2$) by bar coating, and dried at 100° C. to thereby form a thermosensitive recording layer having a dye deposition amount of 0.5 g/m$^2$ on the dry basis.

<Preparation of a Coating Liquid of an Antistatic Agent-Containing Layer>

| -D2 liquid- | |
|---|---|
| 10% polyvinyl alcohol aqueous solution | 20 parts |
| Tin oxide-coated titanium oxide particles (W-4, manufactured by Mitsubishi Materials Corporation) | 20 parts |
| Water | 60 parts |

The mixture of the above formulation was pulverized and dispersed so as to have an average particle diameter of 1.00 μm.

| -A coating liquid of an antistatic agent-containing layer- | |
|---|---|
| 10% itaconic acid modified polyvinyl alcohol aqueous solution (SD-1000, manufactured by KURARAY Co., Ltd.) | 36 parts |
| D2 liquid | 22 parts |
| Water | 42 parts |

The obtained coating liquid of the antistatic agent-containing layer was applied on the opposite surface of the support to the surface thereof where the thermosensitive recording layer had been formed by bar coating, and then dried at 100° C. to thereby form an antistatic agent-containing layer having a deposition amount of 3.0 g/m$^2$ on the dry basis.

Here, the deposition amount of the tin oxide-coated titanium oxide particles was 1.50 g/m$^2$.

Thereafter, calendering was performed thereon to thereby form a thermosensitive recording medium.

Example B-2

The thermosensitive recording medium was prepared in the same manner as in Example B-1, provided that the deposition amount of the tin oxide-coated titanium oxide particles was changed to 1.00 g/m$^2$.

Example B-3

The thermosensitive recording medium was prepared in the same manner as in Example B-1, provided that the deposition amount of the tin oxide-coated titanium oxide particles was changed to 0.50 g/m$^2$.

Example B-4

The thermosensitive recording medium was prepared in the same manner as in Example B-1, provided that the deposition amount of the tin oxide-coated titanium oxide particles was changed to 0.10 g/m$^2$.

Example B-5

The thermosensitive recording medium was prepared in the same manner as in Example B-1, provided that the deposition amount of the tin oxide-coated titanium oxide particles was changed to 0.05 g/m$^2$.

Example B-6

The thermosensitive recording medium was prepared in the same manner as in Example B-3, provided that the average particle diameter of D2 liquid was changed to 5.00 μm by means of a sand mill during the preparation of D2 liquid.

Example B-7

The thermosensitive recording medium was prepared in the same manner as in Example B-3, provided that the average particle diameter of D2 liquid was changed to 6.00 μm by means of a sand mill during the preparation of D2 liquid.

Example B-8

The thermosensitive recording medium was prepared in the same manner as in Example B-3, provided that the average particle diameter of D2 liquid was changed to 0.20 μm by means of a sand mill during the preparation of D2 liquid.

Example B-9

The thermosensitive recording medium was prepared in the same manner as in Example B-3, provided that the average particle diameter of D2 liquid was changed to 0.06 μm by means of a sand mill during the preparation of D2 liquid.

Example B-10

Preparation of a Coating Liquid of an Under Layer

To 100 parts by weight of plastic hollow particles (styrene-acryl copolymer, having hollowness of 50% and an average particle diameter of 1.0 μm), 5 parts by weight of polyvinyl alcohol (partially saponificated carboxy-modified) was added, then added and diluted with water, and the mixture was stirred for 30 minutes to thereby prepare a coating liquid having a solid content of 22.0%.

The thus prepared coating liquid of the under layer was applied onto one surface of a commercial fine paper (basis weight of 80 g/m$^2$) by bar coating, and dried at 100° C. to thereby form an under layer so as to have the deposition amount thereof of 3.5 g/m$^2$ on the dry basis.

Moreover, a thermosensitive recording layer was formed on the under layer using the coating liquid of the thermosensitive recording layer in the same manner as in Example B-3, and an antistatic agent-containing layer was formed on the opposite surface of the support to the surface thereof where the thermosensitive recording layer had been formed using the coating layer of the antistatic agent-containing layer in the same manner as in Example B-3, to thereby prepare a thermosensitive recording medium.

Example B-11

A thermosensitive recording medium was prepared in the same manner as in Example B-10, provided that the following coating liquid of the over layer was used, and applied on the thermosensitive recording layer of Example B-10 by bar coating so as to have a deposition amount of 3.0 g/m$^2$ on the dry basis.

<Preparation of a Coating Liquid of an Over Layer>

| | |
|---|---|
| 10% polyvinyl alcohol aqueous solution | 10 parts |
| 10% aluminum hydroxide aqueous dispersion | 3 parts |
| 10% polyamide-epichlorohydrin resin aqueous solution | 3 parts |

Example B-12

A thermosensitive recording medium was prepared in the same manner as in Example B-11, provided that the following coating liquid of the over layer was used.

| | |
|---|---|
| 10% polyvinyl alcohol aqueous solution | 10 parts |
| 10% aluminum hydroxide aqueous dispersion | 3 parts |
| 10% polyamide-epichlorohydrin resin aqueous solution | 3 parts |
| D2 liquid | 1 part |

Example B-13

A thermosensitive recording medium was prepared in the same manner as in Example B-11, provided that a polyethylene stretched synthetic film was used as the substrate in place of the fine paper.

Example B-14

An thermosensitive/inkjet hybrid recording medium was prepared in the same manner as in Example B-11, provided that the following coating liquid of the antistatic agent-containing layer was used.

| | |
|---|---|
| A1 liquid | 50 parts |
| B1 liquid | 20 parts |
| 10% itaconic acid-modified polyvinyl alcohol aqueous solution | 100 parts |
| 20% polyamide-epichlorohydrin resin aqueous solution | 12 parts |

Comparative Example B-1

A thermosensitive recording medium was prepared in the same manner as in Example B-1, provided that D2 liquid was removed from the coating liquid of the antistatic agent-containing layer.

Comparative Example B-2

A thermosensitive recording medium was prepared in the same manner as in Example B-10, provided that D2 liquid was removed from the coating liquid of the antistatic agent-containing layer.

Comparative Example B-3

A thermosensitive recording medium was prepared in the same manner as in Comparative Example B-2, provided that itaconic acid-modified polyvinyl alcohol used as a binder resin in the coating liquid of the antistatic agent-containing layer was replaced with polyvinyl alcohol.

Comparative Example B-4

A thermosensitive recording medium was prepared in the same manner as in Example B-1, provided that the following coating liquid of the antistatic agent-containing layer was used.

| | |
|---|---|
| 10% polyvinyl alcohol aqueous solution | 36 parts |
| Cationic antistatic agent (CHEMISTAT 7005, manufactured by Sanyo Chemical Industries, Ltd.) | 11 parts |
| Water | 53 parts |

Comparative Example B-5

A thermosensitive recording medium was prepared in the same manner as in Example B-13, provided that D2 liquid was removed from the coating liquid of the antistatic agent-containing layer.

The thus prepared thermosensitive recording medium was subjected to the following tests, and the results are shown in Table 3.

<Amount of Charge>

The thus prepared thermosensitive recording medium was conveyed by using a thermosensitive printer (96 Xi III plus, manufactured by Zebra Technologies Corporation) at a conveyance speed of 4 ips, and the charged amount (V) of the thermosensitive recording medium at the outlet roller part was measured by ELECTROSTATIC VOLTMETER (MODEL 542, manufactured by TREK Japan KK). This evaluation test was carried out at the temperature of 23° C., and humidity of 50%, and also at the temperature of 5° C., and humidity of 30%.

<Generated Amount of Paper Powder>

The prepared thermosensitive recording medium in the size of A4 was torn by hands for 50 times, and the amount of paper powder generated during tearing was visually observed.

A: no paper powder was generated

B: paper powder was slightly generated

C: paper powder was generated in the large amount

<Abrasion of a Cutter>

Three pieces of the prepared thermosensitive recording mediums in the size of A4 were stacked, and the two pieces thereof from the top were cut in the lengthwise direction by a cutter (HA-100S Standard, manufactured by KOKUYO Co., Ltd.). After performing this procedure for 100 times, the wear amount of the cutter was observed under a laser microscope (VK-8510, manufactured by KEYENCE Corporation).

A: no wearing of the cutter was observed

B: slight wearing of the cutter was observed

C: a significant amount of wearing was observed in the cutter

<Image Density>

Printing was performed by means of a thermal gradient testing machine at 150° C. and 2 kg/cm$^2$×1 s, and the color optical density thereof was measured by a Macbeth optical densitometer RD-914.

<Properties Against a Plasticizer>

On a test piece to which printing had been performed by means of a printing simulator for a thermosensitive recording material manufactured by Okura Denki Co., Ltd. at 0.45 mj/dot, three layers of polyvinyl chloride wrapping films were placed, 10 pieces of fine paper were placed thereon, and weights were further placed thereon so as to be about 200 g/cm$^2$. In this condition, the test piece was stored at 40° C. for 24 hours. Thereafter, the density of the image part was measured, and the remaining rate [(density after the test/density before the test)×100(%)] of the printed image was calculated. High remaining rate means that the amount of color loss due to the influence from a plasticizer was small, and it is excellent in anti-plasticizer (storage stability).

TABLE 3

| | Charged amount | | Paper powder | | | Anti- |
|---|---|---|---|---|---|---|
| | 23° C., 50% | 5° C., 30% | generated amount | Cutter wearing | Image density | plasticizer |
| Ex. B-1 | 3.2 KV | 3.5 KV | A | B | 1.25 | 40% |
| Ex. B-2 | 3.5 KV | 3.5 KV | A | A | 1.24 | 42% |
| Ex. B-3 | 3.4 KV | 3.5 KV | A | A | 1.28 | 39% |
| Ex. B-4 | 3.5 KV | 3.7 KV | A | A | 1.28 | 40% |
| Ex. B-5 | 4.8 KV | 4.8 KV | A | A | 1.25 | 40% |
| Ex. B-6 | 3.5 KV | 3.4 KV | A | A | 1.25 | 42% |
| Ex. B-7 | 4.5 KV | 4.2 KV | A | B | 1.26 | 41% |
| Ex. B-8 | 3.6 KV | 3.8 KV | A | A | 1.26 | 42% |
| Ex. B-9 | 5.0 KV | 5.2 KV | A | A | 1.25 | 40% |
| Ex. B-10 | 4.0 KV | 4.1 KV | A | A | 1.45 | 40% |
| Ex. B-11 | 4.0 KV | 4.0 KV | A | A | 1.40 | 85% |

TABLE 3-continued

| | Charged amount | | Paper powder | | | Anti- |
|---|---|---|---|---|---|---|
| | 23° C., 50% | 5° C., 30% | generated amount | Cutter wearing | Image density | plasticizer |
| Ex. B-12 | 3.1 KV | 3.1 KV | A | B | 1.41 | 86% |
| Ex. B-13 | 4.8 KV | 5.1 KV | A | A | 1.40 | 85% |
| Ex. B-14 | 3.1 KV | 3.3 KV | A | B | 1.41 | 86% |
| Comp. Ex. B-1 | 8.2 KV | 8.5 KV | A | A | 1.24 | 40% |
| Comp. Ex. B-2 | 9.0 KV | 9.8 KV | A | A | 1.45 | 40% |
| Comp. Ex. B-3 | 9.0 KV | 9.8 KV | C | A | 1.44 | 40% |
| Comp. Ex. B-4 | 3.2 KV | 6.5 KV | C | A | 1.25 | 39% |
| Comp. Ex. B-5 | 9.9 KV | 11.1 KV | A | A | 1.40 | 85% |

What is claimed is:

1. A recording medium comprising:

a support; and an antistatic agent-containing layer comprising a binder resin and tin oxide-coated titanium oxide particles, wherein the binder resin is itaconic acid-modified polyvinyl alcohol.

2. The recording medium according to claim 1, wherein the tin oxide-coated titanium oxide particles have a volume average particle diameter of 0.2 μm to 5.0 μm.

3. The recording medium according to claim 1, wherein the antistatic agent-containing layer comprises the tin oxide-coated titanium oxide particles in an amount of 0.1 g/m$^2$ to 1.0 g/m$^2$.

4. The recording medium according to claim 1, wherein the support is any of a paper base, a nonwoven fabric base, a synthetic paper base, or a resin film base.

5. The recording medium according to claim 1, wherein the antistatic agent-containing layer comprises the tin oxide-coated titanium oxide particles in an amount of 5% to 50% in a weight ratio.

6. A recording medium comprising:

a support; and an antistatic agent-containing layer comprising a binder resin and tin oxide-coated titanium oxide particles, wherein the antistatic agent-containing layer further comprises a high oil-absorbing inorganic pigment.

7. The recording medium according to claim 6, wherein a weight ratio of the high oil-absorbing inorganic pigment to the binder resin is 80% to 200%.

8. The recording medium according to claim 6, wherein the high oil-absorbing inorganic pigment is silica particles having oil absorption of 150 mL/100 g to 350 mL/100 g.

9. A recording medium comprising:

a support; and an antistatic agent-containing layer comprising a binder resin and tin oxide-coated titanium oxide particles, wherein the antistatic agent-containing layer has a two layered structure consisting of a conductive functional layer comprising the tin oxide-coated titanium oxide particles and an inkjet functional layer comprising no tin oxide-coated titanium oxide particles.

10. The recording medium according to claim 1, wherein the recording medium is an inkjet recording medium.

11. The recording medium according to claim 1, further comprising a thermosensitive recording layer disposed on the opposite surface of the support to the surface thereof where the antistatic agent containing layer is disposed, the thermosensitive recording layer comprising a leuco dye and a developer.

12. The recording medium according to claim 11, further comprising an under layer disposed between the support and the thermosensitive recording layer, the under layer comprising hollow particles.

13. The recording medium according to claim 11, further comprising an over layer disposed on the thermosensitive recording layer.

14. The recording medium according to claim 13, wherein the over layer comprises tin oxide-coated titanium oxide particles.

15. The recording medium according to claim 11, wherein the recording medium is a thermosensitive recording medium.

16. The recording medium according to claim 11, wherein the recording medium is a thermosensitive-inkjet hybrid recording medium.

* * * * *